United States Patent [19]

Schubert et al.

[11] Patent Number: 4,505,320

[45] Date of Patent: Mar. 19, 1985

[54] HORIZONTAL CONTINUOUS CASTING PLANT

[75] Inventors: Hermann Schubert, Linz; Heinrich Thöne, Stiedelsbach, both of Austria

[73] Assignee: Voest-Alpine Aktiengesellschaft, Linz, Austria

[21] Appl. No.: 419,708

[22] Filed: Sep. 20, 1982

[30] Foreign Application Priority Data

Oct. 9, 1981 [AT] Austria ..... 4342/81

[51] Int. Cl.[3] ..... B22D 11/00

[52] U.S. Cl. ..... 164/440; 164/441

[58] Field of Search ..... 164/440, 490, 441, 484, 164/442

[56] References Cited

U.S. PATENT DOCUMENTS 3,987,840 10/1976 Birat ..... 164/468

FOREIGN PATENT DOCUMENTS 538425 11/1955 Belgium .
626982 1/1963 Belgium ..... 164/490
1936200 2/1970 Fed. Rep. of Germany ..... 164/440
1758575 2/1971 Fed. Rep. of Germany .
2658242 7/1978 Fed. Rep. of Germany .
54-15424 2/1979 Japan ..... 164/490
55-120453 9/1980 Japan ..... 164/440

OTHER PUBLICATIONS

Haissig et al., "Stand der Entwicklung des Horizontal-Stranggiessens von Edelstahl bei der Böhler AG", Stahl und Eisen, 101, 1981.

Dipl.-Ing. H. A. Krall, "Horizontal-Stranggiessanlagen zur vollkontinuierlichen Herstellung von Pressbolzen aus Kupfer und Kupferlegierungen", Metallwissenschaft und Technik, 33rd year of edition, vol. 12.

*Primary Examiner*—Kuang Y. Lin

*Attorney, Agent, or Firm*—Brumbaugh, Graves, Donohue & Raymond

[57] ABSTRACT

A horizontal continuous casting plant includes a tundish for accommodating melt and at least one through-type mold fastened to the tundish. The tundish is placeable into a position in alignment with a stationary strand guideway and removable from this position, together with the mold. In order to provide a continuous casting plant in which the relative movement between the strand skin and the mold exactly has the desired course and extent, the through-type mold is fixable relative to the base without play in the longitudinal direction of its mold cavity.

12 Claims, 6 Drawing Figures

1
2
3
4
5
6
7
8
8
9
10
12(11)
13
14
15
17(16)
18
18
19
20
21
22
27
27
28

1
2
4
5
6
7
8
8
9
10
13
14
15
17(16)
18
18
19
20
21
22
27
27
28
29
29
30

HORIZONTAL CONTINUOUS CASTING PLANT

BACKGROUND OF THE INVENTION

The invention relates to a horizontal continuous casting plant, in particular for continuously casting steel, comprising a tundish for accommodating the melt and at least one open ends mould fastened to the tundish, the tundish being placeable into a position in alignment with a stationary strand guideway and removable from this position, together with the mould.

In horizontal continuous casting plants, the mould forms a unit with the tundish (cf. Stahl und Eisen, 101, 1981, "Stand der Entwicklung des Horizontalstranggie ens von Edelstahl bei der Böhler AG"; "Horizontal-Stranggie anlagen zur vollkontinuierlichen Herstellung von Pre bolzen aus Kupfer und Kupferlegierungen" from Metallwissenschaft und Technik, 33rd year of edition, vol. 12) ["State of Development of Horizontal Continuous Casting of Special Steel at Böhler AG"; "Horizontal Continuous Casting Plants for the Fully Continuous Production of Extrusion Billets of Copper and Copper Alloys"]. The tundish to which the mould is fastened mostly is movable or pivotable on rails transversely to the longitudinal axis of the continuous casting plant, so that it is movable together with the mould from outside of the plant into a position in alignment with a stationary strand guideway, or out of this position for the purpose of maintenance or exchange of the vessel and/or the mould.

The extraction of the strand from the mould takes place discontinuously in horizontal continuous casting plants, a step-wise extraction being applied. After each extraction step the strand is pushed back into the mould by a fraction of the length of an extraction step. This working procedure prevents the strand skin from clinging to the mould fastened to the tundish. Hence the problem that the relative movement between the strand and the mould, which prevents the adhesion of the strand skin to the mould wall, does not exactly correspond to the desired course, since the tundish is not sufficiently fixed relative to the base, due to its movability or pivotability. The play occurring at the moving mechanism of the tundish results in a partial co-reciprocation of the tundish. Furthermore, the limited rigidity of the wall of the tundish, to which the mould is fastened, may lead to a partial co-reciprocation of the mould with the strand, so that also for this reason the relative movement between the strand skin and the mould does not exactly have the desired extent during the extraction and pushing back.

The invention aims at avoiding these difficulties and disadvantages, and has as its object to provide a continuous casting plant in which the relative movement between the strand skin and the mould has the exact desired course and extent.

SUMMARY OF THE INVENTION

This object is achieved according to the invention in that the open ends mould is fixable relative to the base without play in the longitudinal direction of its mould cavity, the mould suitably being fixable relative to the base by means of at least one wedge insertable between a resting plate on the mould and a stationary resting plate. A wedge in this case has the particular advantage that the mould can be fixed to the stationary resting surface independent of its position in the hall, i.e., independent of whether it is nearer or farther removed from the stationary strand guide (according to the play of the moving mechanism of the tundish).

Advantageously, the stationary resting plate is directed at a right angle to the strand way axis, whereas the resting plate on the mould is arranged so as to be inclined to the strand way axis, which results in a particularly favorable force introduction into the mould.

According to a preferred embodiment, by which a symmetrical force introduction into the mould is effected, the resting plate on the mould and the stationary resting plate are divided, the parts of the resting plates each being located symmetrical to the strand way axis.

In order to ensure a centric force introduction into the mould independent of the height position and axial inclination of the mould, the resting plate on the mould is dimensioned as small as possible, i.e., according to the maximally permissible surface pressure.

To prevent a bending stress on the mould structure, the wedge advantageously also is divided, each part of the wedge being placeable into contact with one part of the resting plate of the mould and one part of the stationary resting plate, independent of the other part.

A simple, quickly detachable connection between the mould and the stationary resting surface is characterized in that the stationary resting plate is arranged on a console fastened to the base, wherein the console is connectable with the mould by means of at least one drawing anchor arranged in the direction of the strand way axis, and wherein, furthermore, the drawing anchor suitably is pivotably fastened to the console.

A further preferred embodiment is characterized in that the mould is clampable relative to the base by means of a rotary wedge, in particular an eccentric cam.

In this case, two oppositely acting rotary wedges are advantageously provided, between which a supporting plate mounted to the mould is insertable, both rotary wedges being clampable relative to the supporting plate.

BRIEF DESCRIPTION OF THE DRAWINGS

The invention will now be explained in more detail with reference to the accompanying schematic drawings, wherein.

DESCRIPTION OF EXEMPLARY EMBODIMENTS

Figure 1:
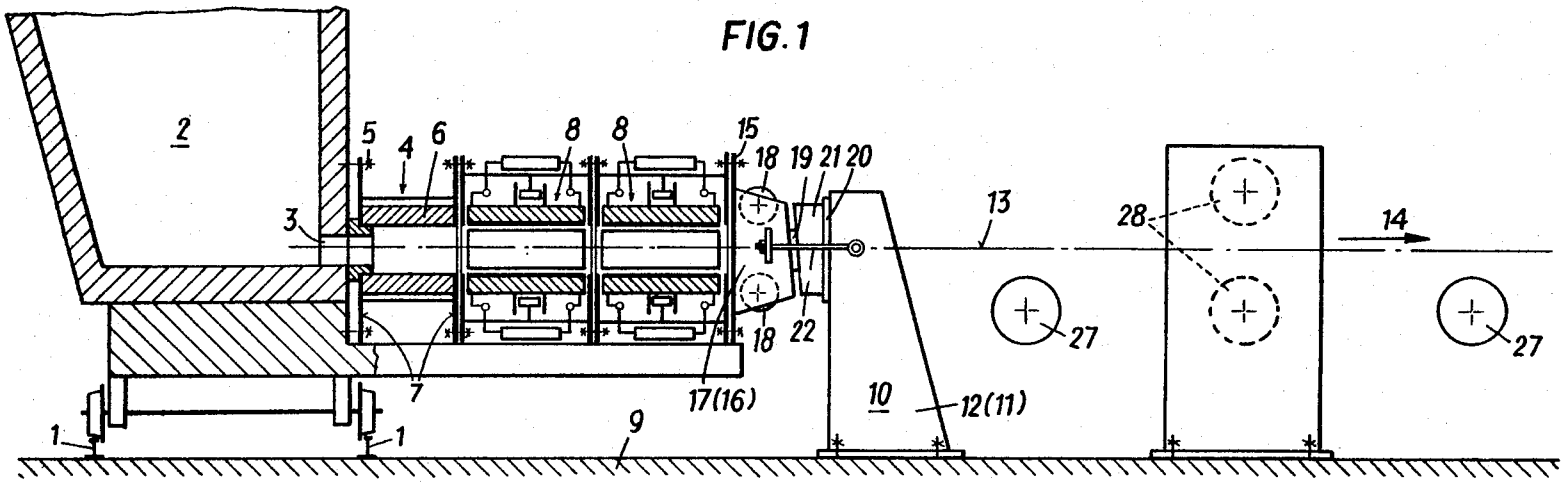
FIG. 1 is a partially sectioned side view of a horizontal continuous casting plant.

With reference first to FIG. 1 an open ends continuous casting mould 4 is fastened by means of screws 5 to a tundish 2 horizontally movable on rails 1 in the region of the discharge opening 3 of the tundish 2. The continuous casting mould 4 comprises a hollow frame 6 through which a coolant flows and which is provided with flange plates 7 on the run-in and run-out sides of the mould. The run-in side flange plate is fastened to the tundish 2, and two secondary cooling means 8 are mounted to the run-out side flange plate.

For a play-free fixation of the mould 4 relative to the base 9, a console 10 is mounted on the base, which comprises two supporting plates 11, 12 located laterally at a distance from the strand way axis 13 (FIG. 3), thus allowing for the passage of a strand. To the rear flange plate 15 of the second secondary cooling means 8, seen in the extraction direction 14 i.e., the plate farthest remote from the tundish 2 strand, of the two further supporting plates 16, 17 also located laterally of the strand way axis, are fastened, carrying an upper and a lower guiding roller 18 for the strand. The ends of these supportng plates 16, 17, seen in the strand extraction direction 14, are wedgedly chamfered, each carrying a resting plate 19 at the height of the strand way axis 13. Between these resting plates 19 and vertical counter resting plates 20 on the supporting plates 11, 12 of the console 10, a wedge 21 is insertable. The depth of insertion of the wedge 21 varies according to the distance of the supporting plates 16, 17 from the console 10.

Figure 2:
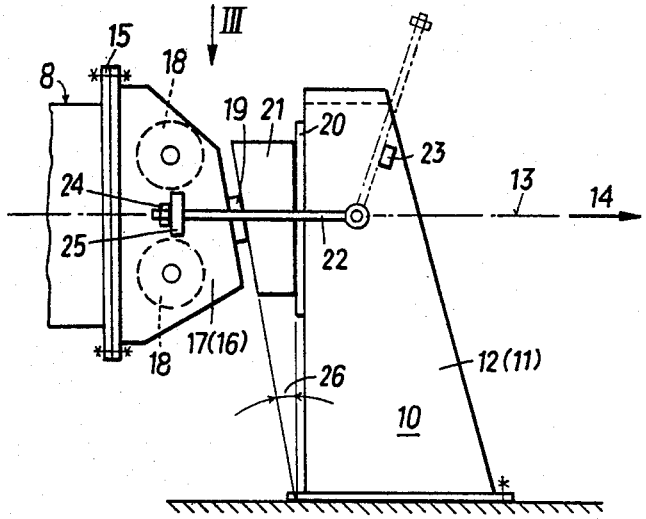
FIG. 2 is a detail of this plant on an enlarged scale.

On each side of the console 10 a drawing anchor 22 is outwardly arranged in a pivotable manner, which can be pivoted from a waiting position, in which it is held by means of a stop 23, into a position parallel to the strand way axis 13 (FIG. 2). On the free end of this drawing anchor 22, a nut 24 is provided, which engages a clamping bracket 25 of the supporting plates 16, 17 from behind, as the drawing anchor is pivoted towards the mould. By tightening these nuts 24, the mould 4 is fixable to the console. With reference to FIG. 2, the wedge angle 26 of the wedge is chosen so small that self-locking will occur, i.e., the wedge cannot be loosened by forces acting in the direction of the strand way axis 13.

Figure 3:
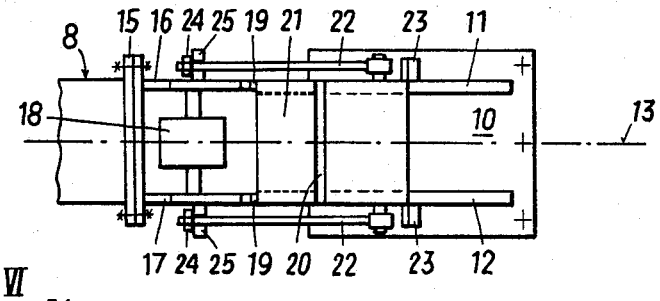
FIG. 3 is a view taken in the direction of to the arrow III of FIG. 2.

Since the resting surface for the wedge 21 on the console 10 is designed to be larger than the wedge itself and is arranged in a vertical manner, and since the resting plate 19 for the wedge 21, on the side of the mould, is designed to be as small as possible (according to the maximally permissible surface pressure) and is provided at the height of the strand way axis, a centric force introduction of the supporting forces into the mould 4 is guaranteed, independent of the height position and axial inclination of the mould 4 to the console 10. As best illustrated in FIG. 3, the wedge 21 suitably is divided, i.e., a separate wedge piece is provided for each supporting plate pair 16, 11 and 17, 12, bending stresses thus being kept away from the mould structure.

It is also possible to design the resting surface of the wedge on the mould side as well as the stationary resting surface of the wedge on the console so as to be divided in height direction, the parts of the resting surfaces each being located symmetrically to the strand way axis.

The strand guideway, according to FIG. 1, is represented by rollers 27, a pair of drivers 28 being provided in the strand guideway, by which the strand is extracted from the mould while reciprocating.

Figure 4:
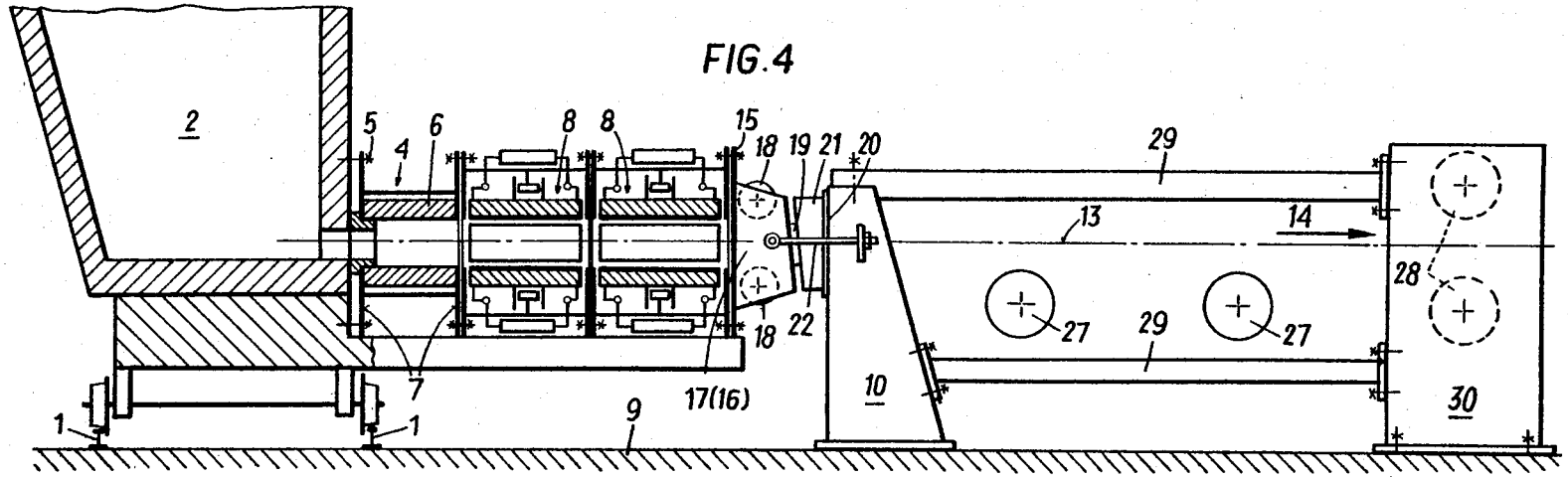
FIG. 4 is a further embodiment of a horizontal continuous casting plant according to the invention.

With the variant illustrated in FIG. 4, the console 10 is not mounted on the base 9, but is merely supported on the base in the vertical direction. In the horizontal direction, i.e. in the direction of the strand way axis 13, the console 10 is fixed by struts 29 on the stand 30 carrying the driver pair 28.

Figure 5:
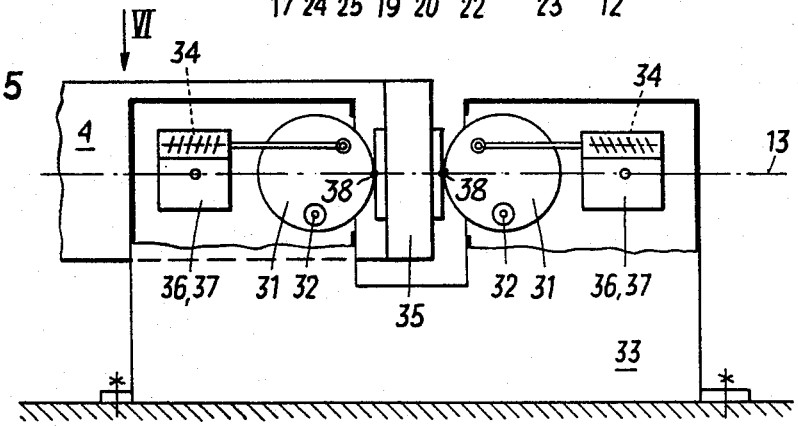
FIG. 5 is an illustration of a third embodiment in an illustration analogous to FIG. 2.
Figure 6:
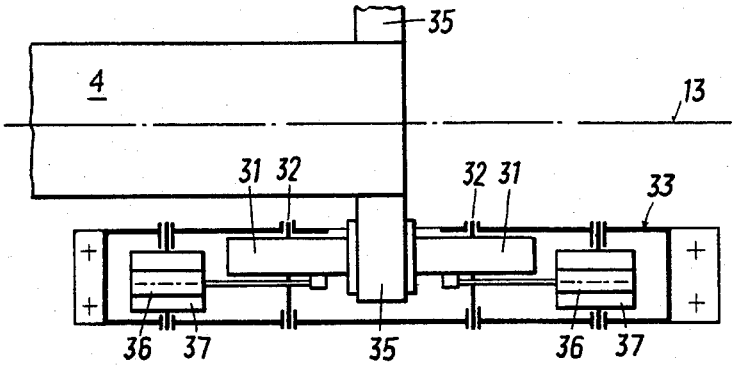
FIG. 6 is a view taken in the direction of the arrow VI of FIG. 5.

The embodiment according to FIGS. 5 and 6 comprises two wedges designed as rotary wedges 31, which are mounted so as to be pivotable about an axis 32 on a stationary casing 33. By means of a self-locking worm gear 34, the rotary wedges may be pressed against a supporting plate 35 of the mould 4. For this purpose, a gear 36 with a motor 37 is provided for each rotary wedge. The rotary wedges act against each other, the supporting plate 35, against which they act, lying between the rotary wedges 31. In order to introduce the force into the mould symmetrically to the mould axis or strand way axis 13, the rotary wedges suitably are arranged in a manner that the lines of contact 38 of the rotary wedges with the supporting plate of the mould are arranged at the height of the strand way axis, as is illustrated in FIG. 5. It is advantageous, if two further rotary wedges are arranged symmetrical to the strand way axis—seen from above—so that bending stresses on the mould structure are largely avoided.

What we claim is:

1. In a horizontal continuous casting plant, in particular for casting steel, of the type including a base, a strand guideway including a stationary, portion supported by said base, a tundish supported by said base for accommodating a metal melt, said tundish having means for moving said tundish along said base into a position in alignment with said strand guideway and removable therefrom, at least one open ends mould fastened to said tundish and defining a mould cavity, and means for extracting a strand from said mould arranged along said strand guideway, the improvement wherein:

said mould is movable, together with said tundish, into and out of said position in alignment with said strand guideway, and wherein said plant further includes means coupled to said mould and said stationary portion of said strand guideway for fixing said mould relative to said base without play in the longitudinal direction of its cavity when said mould is in said position in alignment with said strand guideway.

2. A plant as set forth in claim 1, wherein said fixing means includes a resting plate provided on said mould, a stationary resting plate supported by said base and adjacent said mould resting plate, and at least one wedge insertable therebetween.

3. A plant as set forth in claim 2, wherein said stationary resting plate and said mould resting plate each have a contact face contacted by said wedge, the contact face of said resting plate being directed at a right angle relative to the strand guideway axis, whereas the contact face on said mould resting plate is arranged so as to be inclined relative to the strand guideway axis.

4. A plant as set forth in claim 2, wherein said mould resting plate and said stationary resting plate each comprise a pair of plate parts, each of said plate parts having said contact face thereon, each of said pairs of plate parts being located symmetrical to the strand guideway axis.

5. A plant as set forth in claim 4, wherein said wedge comprises wedge parts, each of said wedge parts, independent of the other wedge part, being insertable into contact with one of said plate parts of said mould resting plate and with one of said plate parts of said stationary resting plate.

6. A plant as set forth in claim 2, further comprising a console fastened to said base for accommodating said stationary resting plate and at least one drawing anchor arranged in the direction of the strand way axis for connecting said console with said mould.

7. A plant as set forth in claim 6, wherein said at least one drawing anchor is pivotably fastened to said console.

8. A plant as set forth in claim 1, wherein said fixing means includes at least one rotary wedge.

9. A plant as set forth in claim 8, wherein said at least one rotary wedge comprises an eccentric cam.

10. A plant as set forth in claim 8, wherein said fixing means comprises two oppositely acting rotary wedges, a supporting plate mounted to said mould and insertable between said two oppositely acting rotary wedges, and means for clamping both rotary wedges against said supporting plate.

11. A plant as set forth in claim 4, wherein said mould resting plate and said stationary resting plate each extend above and below said strand guideway axis, the extensions of said mould resting plate above and below said axis being less than the extensions of said stationary resting plate, and further comprising a clamping means for applying a force to said mould to clamp said mould toward said stationary supporting plate with said mould resting plate and said wedge interposed therebetween, said mould resting plate being of a length sufficient to provide a surface area of said resting plate capable of withstanding said force of said clamping means.

12. A plant as set forth in claim 11, wherein said clamping means includes at least one drawing anchor.

* * * * *